United States Patent [19]

O'Leary

[11] 4,121,804

[45] Oct. 24, 1978

[54] ADJUSTABLE CONCRETE FORM

[76] Inventor: Thomas J. O'Leary, P.O. Box 1490, Iowa City, Iowa 52240

[21] Appl. No.: 815,793

[22] Filed: Jul. 15, 1977

[51] Int. Cl.[2] ..... B28B 7/02

[52] U.S. Cl. ..... 249/187 R; 249/6; 249/157; 249/165

[58] Field of Search ..... 249/3–7, 249/13, 157, 208, 165, 187

[56] References Cited

U.S. PATENT DOCUMENTS

| | | | |
|---|---|---|---|
| 1,842,549 | 1/1932 | Harrold | 249/6 |
| 2,138,634 | 11/1938 | Harrington | 249/7 |
| 2,678,482 | 5/1954 | Cuthbertson et al. | 249/6 |
| 2,722,045 | 11/1955 | Yates et al. | 249/7 |
| 2,745,165 | 5/1956 | Lewis | 249/3 |
| 2,887,756 | 5/1959 | Brechel | 249/6 |
| 2,949,656 | 8/1960 | Pleitgen et al. | 249/157 |
| 3,288,426 | 11/1966 | Simpson | 249/6 |

*Primary Examiner*—Francis S. Husar
*Assistant Examiner*—John McQuade
*Attorney, Agent, or Firm*—Morton S. Adler

[57] ABSTRACT

A concrete form construction unit includes a plurality of like length sections telescopically arranged. The unit is made from lightweight but rigid material, preferably aluminum, for convenience in storage and manual handling and has sections preferably of approximately ten feet in length for telescopic extension to substantial selected lengths. Multiple units can be arranged in self-aligning telescopic connection for indefinite lengths and sections can be used individually, if needed. The sections are of a C or channel shape design with suitable fastening devices for bracing and for securing the unit to a supporting surface and against relative movement of the telescopically extended section.

6 Claims, 9 Drawing Figures

ADJUSTABLE CONCRETE FORM

BACKGROUND OF THE INVENTION

This invention relates to improvements in forms for use in pouring concrete.

Concrete forms have traditionally been of wood or steel and sometimes a combination of the two relating to appropriate bracing and anchoring and while they adequately serve their intended purpose when finally positioned, they have the known disadvantage of requiring considerable time, labor and expense in the assembling, aligning and anchoring necessary for the space requirements of each pouring and in the dismantling or disassembling after the concrete has properly set. In addition, steel forms, as is well known, are lacking in easy adaptability to varying conditions and requirements that may be encountered and with wooden forms their repeated use in constructing different size forms generally involving nailing and re-sizing, there is often waste and destruction of materials. The costs of transporting, handling, assembly and disassembly of such forms including labor and material waste as traditionally incurred are thus relatively high and some endeavors to reduce the cost of form construction, installation and dismantling in a manner to reduce wear and tear and abuse of from material is disclosed in U.S. Pat. Nos. 2,722,045, 2,887,756 and 3,288,426.

Accordingly, with the above observations in mind, it is one of the important objects of this invention to provide an improved concrete form construction embodying lightweight but sturdy material such as aluminum or the like which includes a plurality of telescopically arranged form sections susceptible of being retracted into a simple compact unit convenient for storage, transporting and manhandling and which can be easily and quickly telescopically extended, aligned and fixed at selected random lengths substantially in excess of the capability of current types of forms presently in use.

Another object of this invention is to provide a concrete form as characterized which includes improved easily applied and releasable fastening arrangements for securing the form to a supporting surface such as the ground and at any one or more available anchoring points provided on each form section without damage to the form.

A further object herein is to provide a concrete form of the above class wherein the several sections in a telescopic extended position can be quickly and easily locked against relative movement with each other.

Still another object of this invention is to provide a lightweight concrete form construction including a form unit having preferably, four ten foot sections telescopically arranged wherein the sections can be extended for use as a single telescopically connected form or can be removed and used individually or a plurality of units can, by suitable orientation of mating sections, be telescopically arranged for any required length.

Another object herein is to provide an economically fabricated concrete form construction which can be arranged and disarranged repeatedly and adjusted for concrete pouring areas of any desired dimensions without damage to or eventual loss of any portion of the form material due to wear and tear and sizing adjustments.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figures 1, 4, 5, 8, 9:
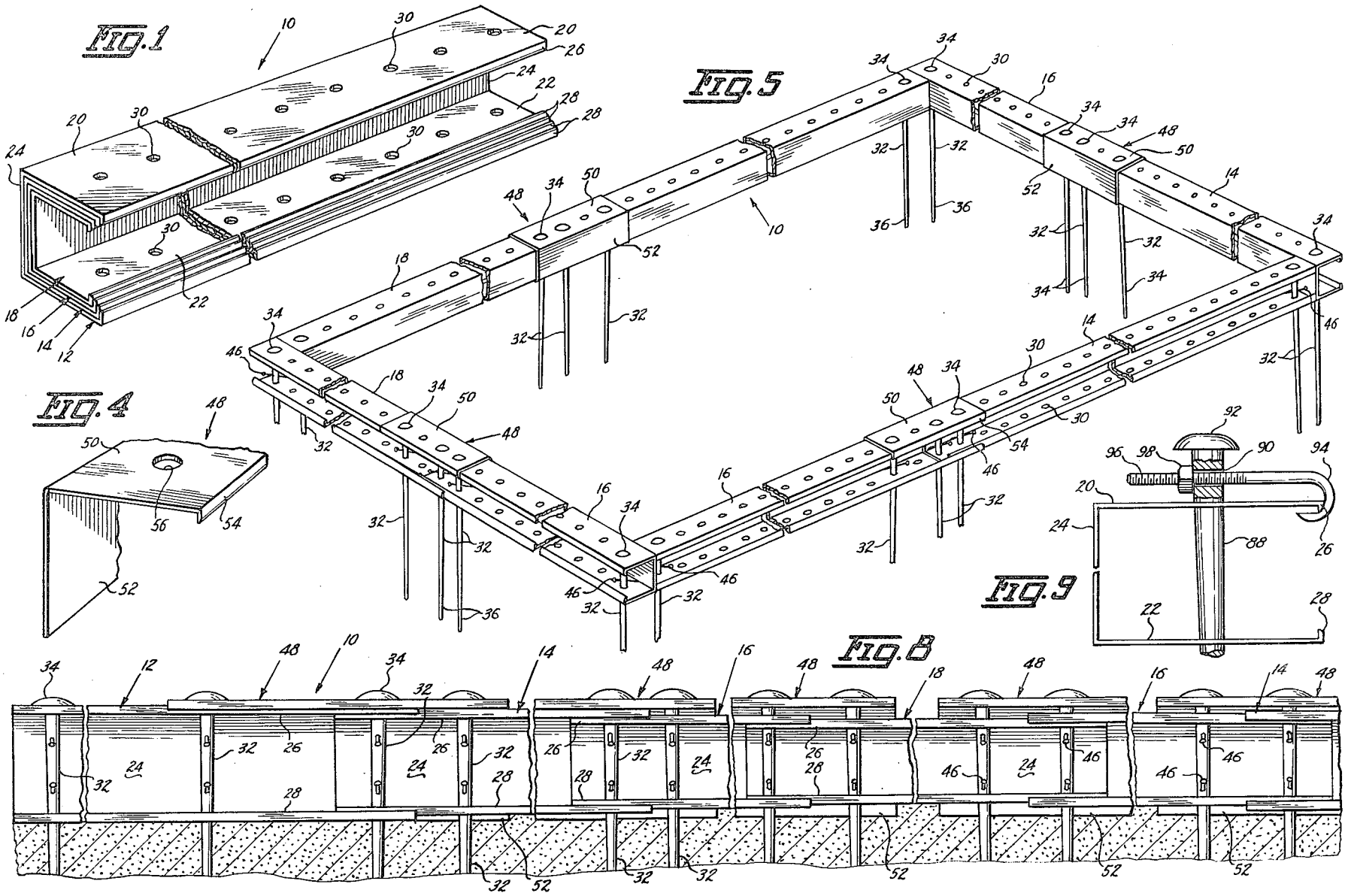
FIG. 1 is a perspective foreshortened view of my new multiple section telescopically adjustable concrete form construction unit shown in full retracted position.
FIG. 4 is a fragmentary perspective view of the inverted L clamp shown in FIG. 3.
FIG. 5 is a perspective foreshortened view showing a plurality of these construction form units arranged to provide a form of a generally rectangular shape.
FIG. 8 is a foreshortened side elevational view illustrating the telescopic connection of one extended form unit to a second form unit.
FIG. 9 is a side elevational view of another embodiment of an anchor stake for use with this invention.
Figure 2:
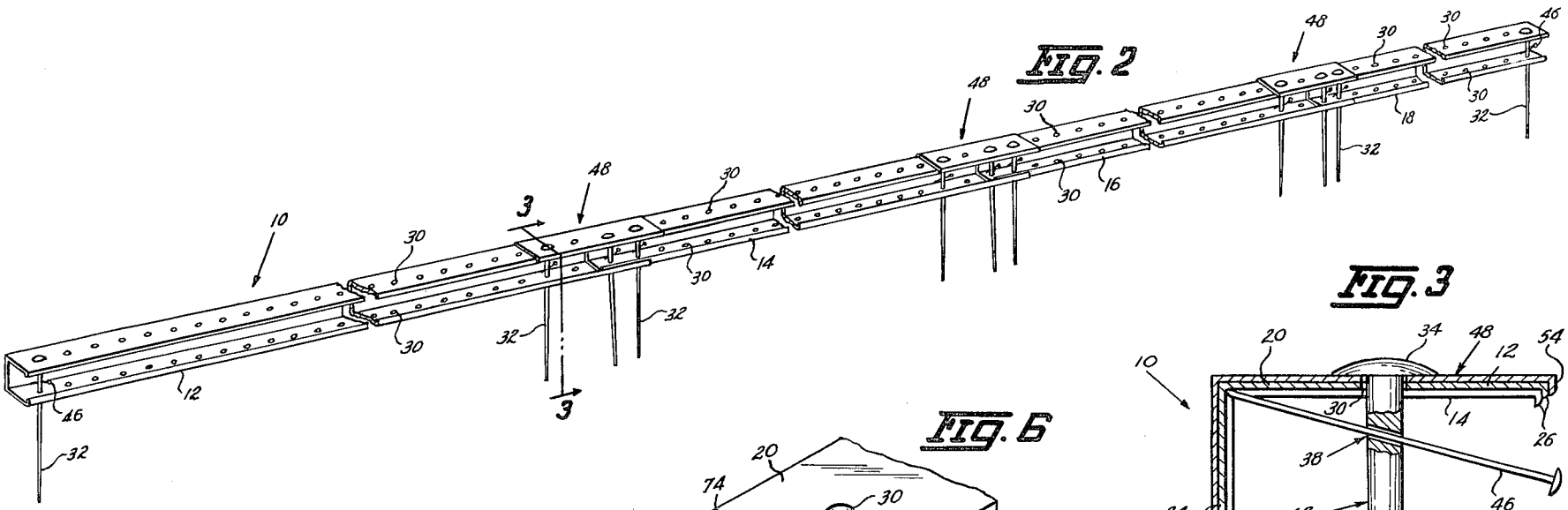
FIG. 2 is a perspective foreshortened view of the form unit in FIG. 1 telescopically extended to provide a form side and showing means for securing said unit and anchoring it to a supporting surface such as the ground.

Referring to the drawings, the preferred embodiment of this adjustable concrete form construction is designated generally by the numeral 10 as best seen in FIG. 1 and comprises a plurality of channel or C-shaped sections adapted for telescopic arrangement. Preferably, I use four such sections although more or less can be used, if desired and these are identified from the outer or larger in cross section of the sections to the inner or smaller in cross section by the respective numerals 12, 14, 16 and 18.

Form sections 12, 14, 16 and 18 are preferably of equal length and I have made them ten feet although the exact length may be varied. All sections are of like shape except for size in cross section so that like numerals are given for like components which include the vertically spaced upper and lower horizontal arms 20 and 22 that are connected at corresponding ends by the vertical web or wall 24 which provides a surface for the cavity to be filled. The free end of each upper arm 20 has a downwardly extending lip 26 and the corresponding end of each lower arm 22 has a similar upwardly extending lip 28. Each arm 20 and 22 is provided with a plurality of longitudinally and equally spaced holes 30 whereby in the telescopic extension of the respective sections as will appear, respective holes 30 in arms 20 and 22 can be brought into register.

One of the important features of this new form is its efficiency and utility as will appear which is provided by the fact that this form is relatively light in weight, but sturdy, as compared with other types of concrete forms, and for such purpose I have preferably used aluminum that has reduced the weight approximately sixty percent relative to a comparable form of steel and, it will be understood, that other materials comparable in weight and strength can also be used.

Thus far described, it is pointed out that a form unit comprising the four sections 12, 14, 16 and 18 provide a convenient assembly when retracted as seen in FIG. 1 that occupies a minimum of space for storage or loading for transportation to a work site and which can generally be handled by one person, if necessary. At the same time, such unit can be telescopically extended without separating any section to provide a form of any desired length up to approximately thirty eight feet more or less depending upon the amount of overlap of the sections. The arrangement of the form for a selected length within such range does not require any cutting or mutilation of any section and thus provides advantages in time, labor and utility that are not present in forms of the type presently used. It will be understood that while sections 12, 14, 16 and 18 can be completely separated to enclose a small pouring area, it is generally anticipated that a sufficient number of units 10 will be available for use in erecting forms for relatively larger pouring areas so that additional units 10, where required, can be used and arranged as illustrated in FIG. 5. By this arrangement, placing the form 10 to serve a required dimension area is a simple and economical part of the work and such forms, when placed, are secured and anchored as follows.

Figure 3:
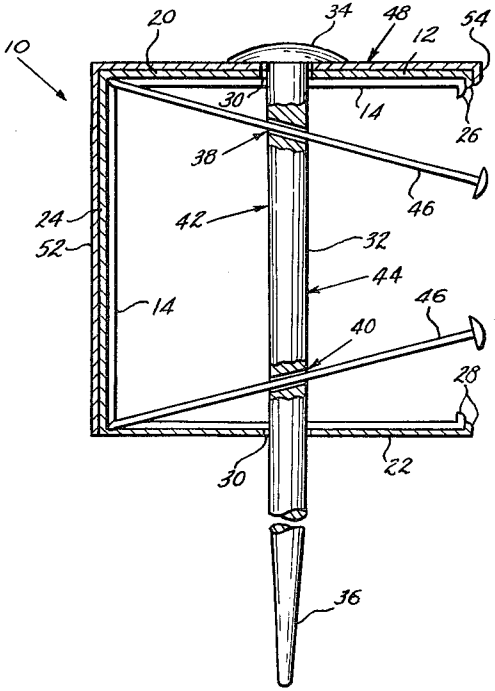
FIG. 3 is a cross sectional view taken on the line 3—3 of FIG. 2.

In telescopically extending unit 10 as described to the desired length, it will be understood that holes 30 in the several related nested sections are placed in register and with unit 10 suitably aligned in any well known manner, a stake 32 is driven into the ground through holes 30 in arms 20 and 22 at each end of the extended form and at such other points inbetween as may appear necessary. Stakes 32 are preferably 18 to 24 inches long of rolled steel material with a bolt-like head or cap 34 and a tapered lower end 36. The diameter of stake 32 closely approximates the diameter of holes 30 for a snug fit to prevent any relative lateral movement of the respective aligned sections. This arrangement of stakes 32 will generally secure forms 10 for its intended purpose but, preferably, I provide additional support or bracing (FIG. 3) particularly to enhance the stability of the form and guard against a possible vertical shifting in the event the ground surface may not be suitably level. As shown in FIG. 3, stake 32 is provided with aligned and longitudinally spaced transverse holes 38 and 40 intermediate cap 34 and end 36 wherein such spacing will assure that holes 38 and 40 are within the confines of arms 20 and 22 and spaced therefrom respectively after the stake is driven into the ground. The axes of holes 38 and 40 are oppositely angled relative to the longitudinal axis of stake 32 so that the spacing of such holes on one side of the stake such as 42 is greater than the spacing on the opposite side 44. The stake 32 is driven into the ground so that side 44 of holes 38 and 40 is oriented toward the open channel side of unit 10 whereby the axes of holes 38 and 40 are in a diverging relationship toward the inner extremities of the form. Elongated nails 46 are driven in a calculated tight fit arrangement through holes 38 and 40 to bear against the respective upper and lower inner extremities of the form as shown and this provides a simple but rigid support.

A further feature of this invention is an inverted L-shaped cover or clamp 48 as best seen in FIGS. 4 and 5. Clamp 48 includes a horizontal top member 50 secured to or integral with a depending vertical side 52. The free edge of top 50 has a depending lip 54 and top 50 is provided with a plurality of spaced holes 56 corresponding in size and spacing to holes 30 in form arms 20 and 22. Clamp 48 is designed to embrace or nest on an extended unit 10 at those points where one section extends outwardly from a related section and thereby provides a protecting cover over such overlap. For this purpose, top 50 may be on the order of 12 to 18 inches long so that two or more holes 56 will register with holes 30 for receiving stakes 32. Clamp side 52 conforms in size to form side 24 and lip 54 will nest over lip 26. Clamp 48 thus serves to protect the overlapping points of the several sections from contact with the wet cement and to act as a splice-like support at such areas.

Figure 6:
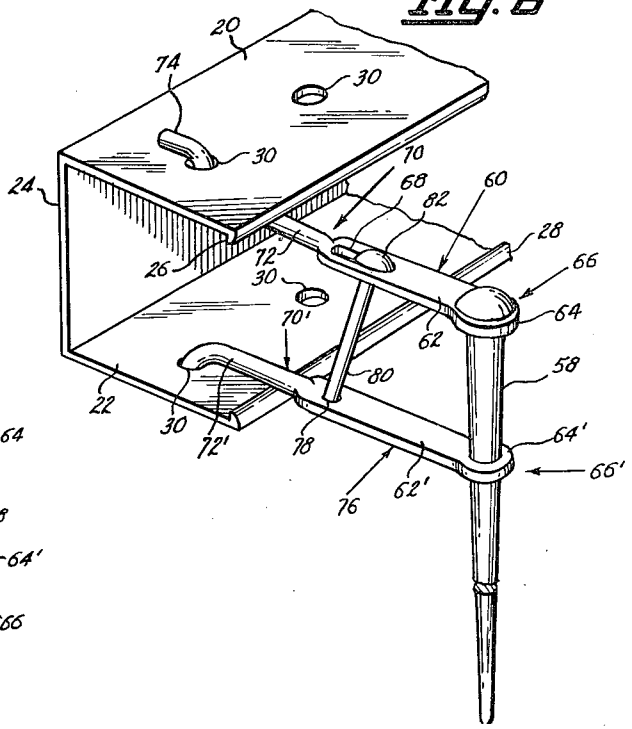
FIG. 6 is a perspective view of a second embodiment of a form securing and ground engaging device shown in relation to a section of this form.
Figure 7:
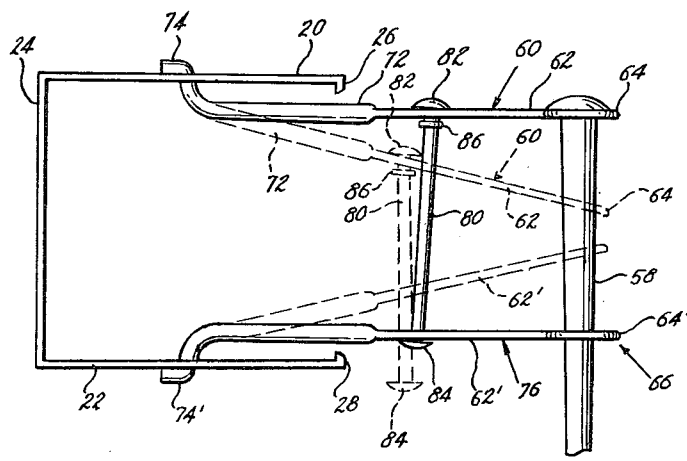
FIG. 7 is a side elevational view of the device in FIG. 6 with the solid lines being the operable or anchoring position and the broken lines being the initial position preparatory to anchoring.

I have provided modified forms of anchor stake assemblies for use with unit 10 of which one is shown in FIGS. 6 and 7 and another in FIG. 9. With reference to FIGS. 6 and 7, an anchor stake 58 is provided that is substantially the same as stake 32 but without the holes 38 and 40 which are not required although a stake 32 can, of course be used. An upper form engaging arm 60 includes a length of spring steel bar material 62 having an eye 64 with a vertical axis on one end 66 and an elongated slot 68 at the other end 70. Projecting longitudinally from end 70 of bar 62 and integral therewith is the rod length 72 that, at its outer end, is bent angularly and then forwardly to form a hook 74. A lower form engaging arm 76 is similar in construction to arm 60 except that a hole 78 is used instead of slot 68 and otherwise, like parts are given like numerals primed.

Arms 60 and 76 are disposed in opposed relationship so that hook 74 on the upper arm 60 extends upwardly and forwardly and hook 74' on the lower arm 76 extends downwardly and forwardly as best seen in FIG. 7. An elongated tightening or lock rod 80 extends through slot 68 and hole 78, the latter being oversize relative to the diameter of rod 80, and suitable caps 82 and 84 are secured to rod 80 on the respective outer sides of arms 60 and 76. Spaced closely below cap 82, a stop ring or collar 86 is secured to rod 80 for engaging the underside of bar 62 as will become apparent. Thus far described, the broken lines in FIG. 7 show arms 60 and 76 in their inoperative or non-supporting position where they are loosely connected by bar 80 that rests freely and generally vertically in slot 68 and hole 78. Hooks 74 and 74' are moved into form 10 intermediate arms 20 and 22 so that hook 74 can be inserted upwardly through hole 30 in arm 20 toward side 24 and hook 74' can be inserted downwardly through hole 30 in arm 22 toward side 24 as seen in FIG. 7. At this point, members 62 and 62' on arms 60 and 76 extend in a converging relationship beyond the open side of form 10 as shown in the broken lines of FIG. 7 where stake 58 can be passed through eyes 64 and 64' and driven into the ground. Then, with a suitable hammer or mallet applied to cap 82, rod 80 is wedgedly moved in slot 68 towards stake 58 to move arms 60 and 76 to the solid line position of FIG. 7 where the tension force of such arms provides a secure support for the form. This anchoring means is easily removed by returning rod 80 to its broken line position.

With reference now to FIG. 9, there is provided a suitable anchor stake 88 having a transverse hole 90 spaced closely below the cap or head 92. Stake 88 is driven through holes 30 into the ground similarly to stake 32 but only to a point where hole 90 remains above arm 20. A hook 94, at one end of an elongated threaded shank 96, is engaged with lip 26 of arm 20 with shank 96 extended through hole 90 and secured against stake 88 by a nut 98 as shown to provide a simple but efficient means for stabilizing the form.

It will be appreciated from the foregoing that this new form may be used, reused, erected and dismantled repeatedly and in each instance can be easily and quickly accommodated and adjusted to different unlimited dimensional requirements without the necessity of being cut or mutilated. It will be apparent that the amount of linear feet in one unit 10 makes it possible to use the sections individually, when convenient, and to use an indeterminate number of units if the site requires. In this regard, reference is made to FIG. 8 where there is shown more than one unit 10 longitudinally assembled. Viewing FIG. 8 from left to right, one form unit 10 is shown extended to the right whereby sections 12, 14, 16 and 18 appear in telescopic extension. If the length of the desired form is greater than can be obtained in one unit 10, a second unit 10 is used as follows. The second or succeeding unit 10 to be attached is extended in the direction opposite to that of the first. This places two sections 18 in opposed relationship so that section 18 in the second unit is removed to provide a telescopic conncection of section 18 on the first unit with section 16 on the second unit as seen at the right side of FIG. 8. Further, in the event that still more units are required and with the extended far section of the second unit being 12, section 12 of the succeeding unit is removed so that section 12 of the second unit can mate with section 14 of the third unit. Such an arrangement can, of course, continue as required. Accordingly, in view of the foregoing, it is thought a full understanding of the construction and operation of this invention will be had and the advantages of the same will be appreciated.

I claim:

1. An adjustable concrete form construction, comprising:

a plurality of like length channel shaped sections similarly oriented in telescopic arrangement to define a form unit, each section including vertically spaced horizontal upper and lower arms and a vertical side connecting corresponding ends of said arms, each upper and lower arm on each section being provided with a plurality of longitudinally like spaced openings so that each opening in each upper arm is in register with an opposed opening in the corresponding lower arm, said form unit susceptible of manual telescopic extension to any precise selected length within the length limits of said sections up to a point where at least one pair of opposed openings in each section is in register with at least one pair of opposed openings in at least one other section, a respective stake member disposed through selected opposed openings in said upper and lower arms in each section and into a supporting surface, each stake member being provided with a pair of longitudinally spaced transverse openings disposed to be intermediate said upper and lower arms when said stake members are positioned in said supporting surface, the axes of said stake member openings being angularly disposed to the longitudinal axis of said respective stake members and angularly disposed relative to each other, and a respective elongated stop member frictionally but removably journalled through said respective stake member openings so that one end of one stop member bears against a respective upper arm and one end of the other stop bears against a respective lower arm.

2. As a new article of manufacture, a concrete form comprising:

an elongated channel shaped member including vertically spaced upper and lower horizontal substantially parallel arms and a vertical form side connecting corresponding ends of said arms, said upper and lower arms being provided respectively with a plurality of longitudinally like spaced openings so that each opening in said upper arm registers with an opposed opening in said lower arm, a stake member disposed through selected opposed openings in said upper and lower arms and into a supporting surface, said stake member being provided with a pair of longitudinally spaced transverse openings disposed to be intermediate said upper and lower arms when said stake member is positioned in the supporting surface through said channel shaped member, the axes of said stake member openings being angularly disposed to the longitudinal axis of said stake member and angularly disposed relative to each other, and a respective elongated stop member frictionally but removably journalled through said respective stake member openings so that one end of one stop member bears against said upper arm and one end of the other stop member bears against said lower arm.

3. An adjustable concrete form construction, comprising:

a plurality of like length channel shaped sections similarly oriented in telescopic arrangement to define a form unit, each section including vertically spaced horizontal upper and lower arms and a vertical side connecting corresponding ends of said arms, each upper and lower arm on each section being provided with a plurality of longitudinally like spaced openings so that each opening in each upper arm is in register with an opposed opening in the corresponding lower arm, said form unit susceptible of manual telescopic extension to an precise selected length within the length limits of said sections up to a point where at least one pair of opposed openings in each section is in register with at least one pair of opposed openings in at least one other section, an elongated stake adapted to be driven through selected opposed openings in said upper and lower arms of said sections and into the ground so that an upper portion of said stake extends upwardly from a respective upper arm, said upper portion of said stake being provided with a transverse hole, an elongated threaded shank with a hook on one end, said shank being extended through said hole with said hook end engaged with the end of said respective upper arm opposite the corresponding vertical side, and a nut threadably engaged on said shank for tightening against said stake.

4. An adjustable concrete form construction, comprising:

a plurality of like length channel shaped sections similarly oriented in telescopic arrangement to define a form unit, each section including vertically spaced horizontal upper and lower arms and a vertical side connecting corresponding ends of said arms, each upper and lower arm on each section being provided with a plurality of longitudinally like spaced openings so that each opening in each upper arm is in register with an opposed opening in the corresponding lower arm, said form unit susceptible of manual telescopic extension to any precise selected length within the length limits of said sections up to a point where at least one pair of opposed openings in each section is in register with at least one pair of opposed openings in at least one other section, a pair of relatively strong elongated resilient support arms each having a hook on corresponding ends and each having an eye on the opposite corresponding ends, one of said support arms being provided with an elongated slot intermediate its ends and the other support arm being provided with a hole intermediate its ends, an elongated rod journalled at one end loosely through said hole and at the other end through said slot for movement therein, a respective cap on each end of said rod incapable of passage through said respective hole and slot, a stop on said rod closely spaced from the respective cap on the rod end adjacent said slot and adapted to engage the surface of said slotted support arm opposite to said cap which is adjacent said slot, said respective hooks being engaged in opposed openings in one of said sections so that said support arms extend in a converging relationship outwardly from the open channel side of said section to a point where said eyes are in register, a stake disposed through said eyes into a supporting surface such as the ground, and the end of said rod journalled through said slot being wedgedly movable therein toward said stake whereby said converging arms are moved to parallel position to provide a rigid support for said form unit.

5. As a new article of manufacture, a concrete form comprising:

an elongated channel shaped member including vertically spaced upper and lower horizontal substantially parallel arms and a vertical form side connecting corresponding ends of said arms, said upper and lower arms being provided respectively with a plurality of longitudinally like spaced openings so that each opening in said upper arm registers with an opposed opening in said lower arm, an elongated stake adapted to be driven through selected opposed openings in said upper and lower arms and into the ground so that an upper portion of said stake extends upwardly from said upper arm, said upper portion of said stake being provided with a transverse hole, an elongated threaded shank with a hook on one end, said shank being extended through said hole with said hook end engaged with the end of said upper arm opposite said vertical side, and a nut threadably engaged on said shank for tightening against said stake.

6. As a new article of manufacture, a concrete form comprising:

an elongated channel shaped member including vertically spaced upper and lower horizontal substantially parallel arms and a vertical form side connecting corresponding ends of said arms, said upper and lower arms being provided respectively with a plurality of longitudinally like spaced openings so that each opening in said upper arm registers with an opposed opening in said lower arm, a pair of relatively strong elongated resilient support arms each having a hook on corresponding ends and each having an eye on the opposite corresponding ends, one of said support arms being provided with an elongated slot intermediate its ends and the other support arm being provided with a hole intermediate its ends, an elongated rod journalled at one end loosely through said hole and at the other end through said slot for movement therein, a respective cap on each end of said rod incapable of passage through said respective hole and slot, a stop on said rod closely spaced from the respective cap on the rod adjacent said slot and adapted to engage the surface of said slotted support arm opposite to said cap which is adjacent said slot, said hooks being engaged in opposed openings in said respective upper and lower arms so that said support arms extend in a converging relationship outwardly from the open side of said channel shaped member to a point where said eyes are in register, a stake disposed through said eyes into a supporting surface such as the ground, and the end of said rod journalled through said slot being wedgedly movable therein toward said stake whereby said converging arms are moved to parallel position to provide a rigid support for said channel shaped member.

* * * * *